US009169599B2

(12) United States Patent
Taipale et al.

(10) Patent No.: US 9,169,599 B2
(45) Date of Patent: Oct. 27, 2015

(54) PAPER MACHINE FABRIC

(75) Inventors: Seppo Taipale, Siilinjaervi (FI); Mari Seppänen, Juankoski (FI)

(73) Assignee: VALMET TECHNOLOGIES OY, Espoo (FI)

( * ) Notice: Subject to any disclaimer, the term of this patent is extended or adjusted under 35 U.S.C. 154(b) by 1 day.

(21) Appl. No.: 14/000,470

(22) PCT Filed: Mar. 1, 2012

(86) PCT No.: PCT/FI2012/050206

§ 371 (c)(1),
(2), (4) Date: Aug. 20, 2013

(87) PCT Pub. No.: WO2012/120191

PCT Pub. Date: Sep. 13, 2012

(65) Prior Publication Data

US 2013/0327490 A1 Dec. 12, 2013

(30) Foreign Application Priority Data

Mar. 4, 2011 (FI) ..... 20115222

(51) Int. Cl.
*D21F 1/10* (2006.01)
*D21F 7/08* (2006.01)
(Continued)

(52) U.S. Cl.
CPC ..... *D21F 7/083* (2013.01); *D03D 11/00* (2013.01); *D21F 1/0045* (2013.01); *D21F 7/12* (2013.01)

(58) Field of Classification Search
CPC ... D21F 1/0027; D21F 1/0036; D21F 1/0045; D21F 1/0054; D21F 1/0081; D21F 1/10; D21F 1/105; D21F 1/12; D21F 7/08; D21F 7/083; D21F 7/10; D21F 7/12; D03D 1/00; D03D 1/0094; D03D 3/04; D03D 9/00; D03D 11/00
USPC ..... 162/348, 900, 902, 903, 904, 358.2; 139/383 A, 383 AA, 425 A
See application file for complete search history.

(56) References Cited

U.S. PATENT DOCUMENTS 4,041,989 A 8/1977 Johansson et al.
4,499,927 A * 2/1985 Borel ..... 139/425 A
(Continued)

FOREIGN PATENT DOCUMENTS

EP 0 431 750 A2 6/1991
EP 1 536 060 A1 6/2005
(Continued)

OTHER PUBLICATIONS

Jul. 10, 2014 Search Report issued in European Patent Application No. 12755529.0.
(Continued)

*Primary Examiner* — Eric Hug
(74) *Attorney, Agent, or Firm* — Oliff PLC

(57) ABSTRACT

A paper machine fabric that includes at least two separate layers that are formed of at least two separate yarn systems, one forming the paper side and composed of longitudinal and crosswise yarns and one forming the wear side and composed of longitudinal and crosswise yarns, the yarn systems being arranged to form structures independent of each other in the longitudinal and cross directions of the fabric. The structures are bound to each other by means of a binding yarn system, whereby the binding yarns in the binding yarn system are arranged to form part of the layer on the paper-side surface. Each binding yarn of the binding yarn system is arranged on the wear side to bind in the weave pattern repeat to more yarns than on the paper side.

16 Claims, 10 Drawing Sheets

(51) Int. Cl.

| | |
|---|---|
| ***D21F 7/12*** | (2006.01) |
| ***D03D 11/00*** | (2006.01) |
| ***D21F 1/00*** | (2006.01) |

(56) References Cited

U.S. PATENT DOCUMENTS

| | | | | |
|---|---|---|---|---|
| 4,501,303 | A | 2/1985 | Österberg | |
| 4,967,805 | A | 11/1990 | Chiu et al. | |
| 5,013,330 | A * | 5/1991 | Durkin et al. | 51/297 |
| 5,152,326 | A * | 10/1992 | Vohringer | 139/383 A |
| 5,437,315 | A * | 8/1995 | Ward | 139/383 A |
| 5,826,627 | A | 10/1998 | Seabrook et al. | |
| 5,840,411 | A * | 11/1998 | Stelljes et al. | 442/239 |
| 5,967,195 | A | 10/1999 | Ward | |
| 6,155,308 | A | 12/2000 | Kuji | |
| 6,354,335 | B1 | 3/2002 | Taipale et al. | |
| 6,544,644 | B1 | 4/2003 | Bouquerel et al. | |
| 6,978,809 | B2 | 12/2005 | Quigley | |
| 7,001,489 | B2 | 2/2006 | Taipale et al. | |
| 7,243,687 | B2 | 7/2007 | Barratte | |
| 7,357,155 | B2 * | 4/2008 | Fahrer et al. | 139/383 A |
| 7,581,567 | B2 * | 9/2009 | Ward et al. | 139/383 A |
| 7,584,768 | B2 | 9/2009 | Westerkamp et al. | |
| 2004/0238062 | A1 * | 12/2004 | Quigley et al. | 139/383 A |
| 2005/0067040 | A1 * | 3/2005 | Quigley | 139/383 A |
| 2005/0103397 | A1 * | 5/2005 | Quigley et al. | 139/383 A |
| 2005/0139281 | A1 * | 6/2005 | Martin et al. | 139/383 A |
| 2009/0126412 | A1 * | 5/2009 | Pollet et al. | 66/192 |

FOREIGN PATENT DOCUMENTS

| | | | |
|---|---|---|---|
| EP | 1 734 177 | A1 | 12/2006 |
| WO | WO 2005/014926 | A1 | 2/2005 |
| WO | WO 2007/039672 | A1 | 4/2007 |

OTHER PUBLICATIONS

Dec. 15, 2011 Search Report issued in Finnish Patent Application No. 20115222 (with translation).

Jun. 12, 2012 Search Report issued in International Patent Application No. PCT/FI2012/050206.

Jun. 12, 2012 Written Opinion issued in International Patent Application No. PCT/FI2012/050206.

* cited by examiner

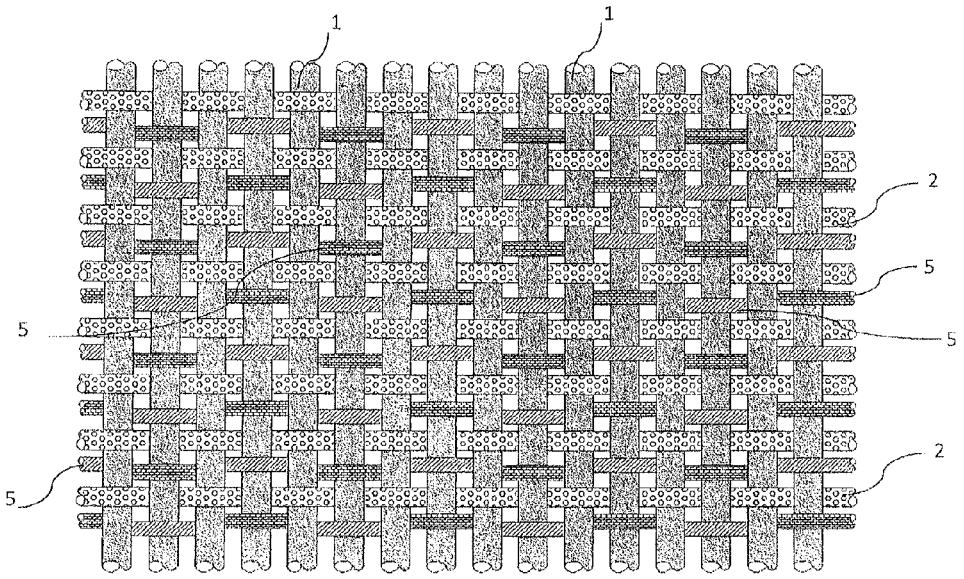
Fig. 13
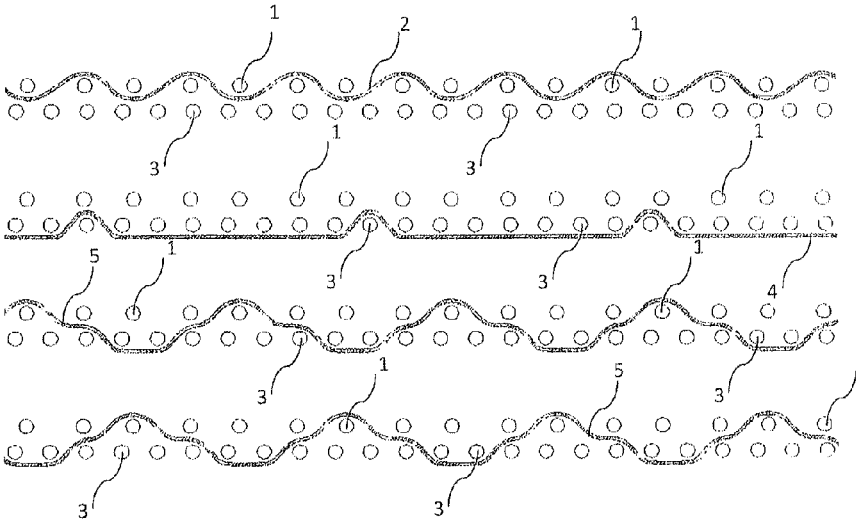
Fig. 14
Fig. 15
Fig. 16
Fig. 17

PAPER MACHINE FABRIC

The invention relates to a paper machine fabric that comprises at least two separate layers formed of at least two separate yarn systems, one forming the paper side and composed of longitudinal and crosswise yarns and one forming the wear side and composed of longitudinal and crosswise yarns, the yarn systems being arranged to form structures independent of each other in the longitudinal and cross directions of the fabric, and the structures being bound to each other by a binding yarn system, wherein the binding yarns of the system are arranged to form part of the layer on the paper-side surface.

Conventional double-layer paper machine fabrics are formed of one longitudinal and two crosswise yarn systems. An example of such solutions is U.S. Pat. No. 4,041,989. Owing to the one longitudinal yarn system, the wires are thin, but also susceptible to breaking.

Paper machine fabrics, in which the binding yarns binding the paper-side and wear-side layers together also participate in forming the paper-side layer, are also known in the field. Structures of this type are called SSB structures. SSB is abbreviated from sheet support binding. Structures of this type are described in the following US patent publications, for instance: U.S. Pat. Nos. 7,243,687, 6,354,335, 6,978,809 and 7,001,489.

All the above solutions have on a single binding yarn in the weave pattern repeat an equal number of or more binding warps on the top side than on the bottom side of the fabric. This causes internal wear and poor stability, for instance.

The art of structures bound with a binding yarn pair is described in U.S. Pat. Nos. 4,501,303, 5,967,195 and 5,826,627, for instance. In structures bound with a binding yarn pair, the binding yarn pair binds the layers together. A binding yarn pair is formed of two side-by-side binding yarns, of which the first makes the paper-side surface binding while the second simultaneously binds the paper-side and wear-side layers together on the wear side under one bottom warp and vice versa. The bends of the binding yarn pair on the paper-side surface form a weft path similar to the top weft. In structures with binding yarn pairs, the longitudinal yarn systems are on top of each other, which increases the thickness of the fabric. In conventional SSB structures, internal wear often occurs, when the layers rub against each other, because the binding yarn forms a long float stitch inside the fabric and does not bind the structure tightly enough. With the rubbing, a material shift occurs inside the fabric, which decreases the permeability and durability of the fabric. Extensive internal wear changes the properties of the fabric and degrades the properties of the paper. A decrease in the fabric permeability emphasizes the cross-direction profile variation of paper, and wear is usually different in different parts of the fabric, resulting in an uneven profile. A slacker binding also allows the bottom yarns to shift in the longitudinal direction. This causes, among other things, uneven dewatering, as a result of which the paper profile is not homogeneous.

Thin yarns are typically used for fine paper grades. The use of such yarns generally shortens the operating life of the fabric and impairs the mechanical strain strength of the fabric. Wear resistance and strengths may be improved by using thicker yarns, but then the paper-side surface of the fabric, for instance, is more uneven, which causes marking in the paper. Markings may be divided into two types: topography and dewatering markings. In topography marking, the paper-side surface of the fabric is copied on to the wet web. In dewatering marking, fines and paper fibres are unevenly distributed in the xy direction in the paper structure, which causes uneven formation. Dewatering marking is dependent on the dewatering channels of the fabric structure. If the binding structure regularly forms repeating openings of different sizes, such as diagonal lines, in the fabric, this pattern will also show in the paper made with the fabric. Therefore, it is important that the openings on the paper surface of the fabric are of the same size, and it is also equally important that the dewatering openings on the bottom side are of the same size.

The first SSB paper machine fabrics in the market were thick structures of approximately 0.80 mm. The second-generation structures were 0.70 mm thick and those of the third generation were 0.65 to 0.70 mm thick. The present especially thin SSB paper machine fabrics are 0.60 to 0.65 mm thick. In thin fabrics, the provision of the required wear reserve is usually a problem. In conventional SSB structures, the loop formed by the crosswise bottom yarn to the wear side is usually short due to the 5-stitch structure. The wear reserve of the fabric then remains shorter than required.

In paper making, most of the fibres are longitudinally arranged. The most ideal shape of a dewatering opening to achieve good mechanical retention is a rectangle, wherein the longitudinal yarns form the shorter sides of the rectangle. The size and shape of the paper-side opening of a paper machine fabric affect the penetration of the fibre inside the fabric. If the size of the opening is not optimal, through-pass occurs which impairs mechanical retention. If paper fibres can penetrate into the paper machine fabric, the machine will become dirty, which causes breaks and the efficiency of the paper machine decreases. The fabrics are kept clean with washers, but if the washers are not in good condition, dewatering from the paper web is uneven, which degrades the paper profiles.

A thick paper machine fabric may cause problems when the paper web is trimmed at the edges. The capacity of an edge trim shower is not enough to push the fibres through the thick structure, and there is a danger of blocking the wire and difficulties in cutting. Edge trimming problems significantly increase breaks at the wet end of the paper machine. In addition, the thicker the paper machine fabric is, the harder it is to keep clean, and extra washing shutdowns are needed.

It is also possible to reduce the thickness of the paper machine fabric by calendering. Calendering is described in publications U.S. Pat. No. 7,727,360 and CA 2 566 520, for instance. In calendering, the paper machine fabric is pressed mechanically so that it begins to drain water from the paper machine right from the start in an optimal manner. The challenge of the method is to be able to make the structure homogeneous within the entire area of the paper machine fabric. The problem in the method is that the paper machine fabric becomes dense and stability decreases. In addition, the investments in equipment and an extra production phase increase the manufacturing costs of the paper machine fabric considerably.

The use of thick longitudinal bottom yarns decreases the machine-direction flexibility of the paper machine fabric. This makes dewatering from the paper web more difficult and impairs paper formation. A stiff paper machine fabric does not conform to the dewatering equipment of the paper machine, which reduces turbulence and impairs dewatering and formation.

Increased velocity also increases fabric tightness. Increased tightness sets new challenges to the paper machine fabric. One of the most important requirements of fabrics is stability. In this text, fabric stability refers to the dimensional stability of the fabric. An example of poor stability is an extensive narrowing of the fabric when it is being tightened and/or the running askew of the fabric, if the paper machine rolls are not entirely straight. In the present SSB structures, the wear-side binding point of the binding yarn has not been locked, whereby the binding yarn is able to move with the bound yarn and stability remains at a low level. With the wear of the fabric, stability becomes poorer.

One reason for a low dry content is a large water space that increases the rewetting phenomenon. During rewetting, water drained from the paper web to the wire absorbs back to the paper web in the wire section after the last dewatering elements before the press section. As a wet paper web enters the press section, more breaks occur and, on the other hand, the steam consumption of the paper machine increases. Both factors add significantly to the costs in a paper machine. A large water space increases the amount of water transported by the fabric. Due to the centrifugal force, especially when running at high speeds, splattering occurs on the roll in the top position of the paper machine, in particular.

The purpose of the invention is to provide a paper machine fabric with which the prior-art disadvantages can be eliminated. This is achieved by the paper machine fabric of the invention. The paper machine fabric of the invention is characterised in that each binding yarn of the binding yarn system is arranged to bind in the weave pattern repeat on the wear side to more yarns than on the paper side and that the binding yarns are arranged to form on the paper side with each other or together with a substitute yarn the same binding as the paper-side yarns in the corresponding direction.

The paper machine fabric of the invention provides the advantage that the fabric structure of the invention permits the use of thin warp and weft yarns on both paper-side and wear-side layers, whereby the structure can be made as thin as or thinner than conventional double-layer structures, but still have the advantages of the SSB structure. Because the paper machine fabric is thin, the structure also has a smaller water space than conventional structures bound with binding yarn pairs. When the water space is small, less above-mentioned rewetting occurs in the structure. Thin warp yarns reduce the machine-direction bending stiffness of the paper machine fabric. A low bending stiffness allows the paper machine fabric to conform to the dewatering equipment of the paper machine to produce good dewatering and paper web formation. A thin structure is also beneficial in edge trimming the paper web. It is easier for the edge trim shower to push the fibres through a thin fabric.

In the paper machine fabric of the invention, the length of the binding yarn is minimised. Owing to this, the paper machine fabric layers are bound tightly together. This provides a thin structure. Because the paper-side bends formed by the binding yarns are alike, all dewatering openings are alike and the top yarns on both sides of the bend formed by each binding yarn are on the same level. The surface of the fabric then does not cause harmful diagonals causing topography marking on the paper web. In the paper machine fabric of the invention, it is possible to use thin yarns on the paper side as both top wefts and binding yarns. In conventional SSB structures, thin binding yarns are not strong enough for the internal wear and break, and the paper machine fabric comes apart as the layers separate from each other.

In the paper machine fabric of the invention, the shift of the bottom wefts is eliminated by a tight binding on the bottom side. A dense number of binding points improves the diagonal stability of the paper machine fabric, which correlates to a good paper machine fabric. A good paper machine fabric runs well on a paper machine and it helps produce even paper profiles. Tight binding prevents the relative movement of the paper-side and wear-side layers and, consequently, no internal wear occurs in the fabric. For the elimination of the internal wear, it is important to bind the layer more susceptible to wear, that is, the wear side. The force binding the layers can then be maximized. The structure of the paper machine fabric of the invention is advantageous in view of internal wear.

In the paper machine fabric of the invention, a long bottom weft float stitch is formed on the wear side. Even though the structure is thin, it provides an optimal wear reserve. The optimal wear reserve corresponds to the thickness of the bottom yarn exactly or nearly. The advantageous structure of the wear side permits the use of thin bottom yarns (e.g. 0.18 mm or thinner). Even though the bottom yarn is worn through, the fabric does not break when it is run into the paper machine. Because the paper machine fabric of the invention is thinner than the conventional SSB paper machine fabric, the run window in the paper machine remains at almost the same level during the entire run time of the paper machine fabric.

In the paper machine fabric of the invention, the paper-side and wear-side warp yarns are distributed. In a distributed structure, the warp yarns of different layers overlap, whereby the top and bottom warp yarns can press between each other and a point-form load cannot form between the yarns, which means that no internal wear occurs. Because there is no internal wear, the thickness remains constant throughout the service life of the wire, if no mechanical wear is directed to the wire, and the run properties remain constant during the operating time of the wire.

In a paper machine fabric of the invention, the top warp density is lower than in conventional SSB paper machine fabrics, and the top weft density may be increased so that the long edge of the rectangular openings on the paper-side surface of the paper machine fabric is in the cross-machine direction of the paper machine, that is, perpendicular to the direction in which the paper fibres mainly orient when the paper web is formed, whereby an optimal fibre support and dewatering is achieved.

In a paper machine fabric of the invention, an 8-stitch bottom side is an advantageous structure. The weft loop forming below then becomes sufficiently long that it can be worn through entirely. Thus, the structure is wear-resistant, even though thin yarns of less than 0.20 mm in diameter, for example, were used as the bottom-side cross-direction yarns.

An interspace coefficient is a theoretical figure that indicates how large a proportion of the fabric content is water. The interspace coefficient E is obtained by:

$$E = \frac{V_T - V_S}{V_T}$$

wherein ($V_T$)=total volume of the fabric, ($V_S$)=volume of the fibres therein. Fibre volume (Vs)=Fibre weight/Fibre specific weight.

In a paper machine fabric, the interspace coefficient should be 0.51 or less so as to minimize harmful water transportation and to prevent the fabric from splattering at high speeds in the paper machine. The paper machine fabric of the invention is also an advantageous structure in view of the above-mentioned fact.

In one embodiment of a paper machine fabric of the invention, it is advantageous to use bottom yarns, in which the contact surface abutting the paper machine parts is not point-form. When a new paper machine fabric starts on a paper machine, the round bottom yarns cannot immediately drain water from the paper web in an optimal manner. As the yarns wear slightly, dewatering improves. Because of this, fabrics have been subjected to wear or calendering as a start treatment, but neither of these methods is cost-effective or produces fabrics of uniform quality. When using yarns with a non-point-form contact surface, the paper machine fabric can be made homogeneous over its entire surface area, and the fabric does not lose its stability or become dense, unlike when the paper machine fabric is calendered.

Because the paper machine fabric of the invention has a high total warp density, the machine-direction elongation of the paper machine fabric remains smaller than in conventional SSB paper machine fabrics. In addition, in an embodiment of the invention, every first bottom yarn runs straighter in the fabric than every second bottom yarn and, thus, the machine-direction elongation of the fabric can be made even smaller.

In a paper machine fabric of the invention, the cover factor of the top warps is clearly lower than that of the bottom warps, which is why funnel-shaped capillaries that are advantageous for dewatering form in the structure. This type of structure is advantageous in respect of rewetting, because capillary forces transport water in the paper machine fabric towards the wear-side layer surface of the structure. The cover factor of the warp is defined as follows:

$$\text{Warp cover factor}=d\times n,$$

wherein d=warp diameter (cm) and n=number of warps per cm.

The paper machine fabric of the invention can also be used when using a substitute weft. This type of embodiment has at least two longitudinal yarn systems, such as a top warp system and a bottom warp system, and at least two cross-directional yarn systems, such as a top weft system and a bottom weft system. In addition, the fabric structure always has a binding yarn system and possibly a substitute weft system. A binding yarn is woven on both sides of the substitute weft in the substitute weft system. The substitute weft is arranged to supplement the two float stitches formed by the above-mentioned two binding yarns on the paper side at locations where said two binding yarns bind on the wear side.

The invention will be explained in the following in more detail by means of working examples described in the attached drawing, in which FIG. 1 shows a first embodiment of the paper machine fabric of the invention as a general paper-side view, FIG. 2 shows the embodiment of FIG. 1 as a general wear-side view, FIG. 3 shows the embodiment of FIGS. 1 and 2 as a view according to arrows III-III, FIG. 4 shows the embodiment of FIGS. 1 and 2 as a view according to arrows IV-IV, FIG. 5 shows the embodiment of FIGS. 1 and 2 as a view according to arrows V-V, FIG. 6 shows the embodiment of FIGS. 1 and 2 as a view according to arrows VI-VI, FIG. 7 shows a second embodiment of the paper machine fabric of the invention as a general paper-side view, FIG. 8 shows the embodiment of FIG. 7 as a general wear-side view, FIG. 9 shows the embodiment of FIGS. 7 and 8 as a view according to arrows IX-IX, FIG. 10 shows the embodiment of FIGS. 7 and 8 as a view according to arrows X-X, FIG. 11 shows the embodiment of FIGS. 7 and 8 as a view according to arrows XI-XI, FIG. 12 shows the embodiment of FIGS. 7 and 8 as a view according to arrows XII-XII, FIG. 13 shows a third embodiment of the paper machine fabric of the invention as a general paper-side view, FIG. 14 shows the fabric of FIG. 13 as a view seen at yarn 2 in the direction of yarns 1, FIG. 15 shows the fabric of FIG. 13 as a view seen at yarn 4 in the direction of yarns 1, FIG. 16 shows the fabric of FIG. 13 as a view seen at yarn 5 in the direction of yarns 1, FIG. 17 shows the fabric of FIG. 13 as a view seen at yarn 5 in the direction of yarns 1, FIG. 18 shows a fourth embodiment of the paper machine fabric of the invention as a view seen at yarn 2 in the direction of yarns 1, FIG. 19 shows the fourth embodiment as a view seen at yarn 2 in the direction of yarns 1, FIG. 20 shows the fourth embodiment as a view seen at yarn 2 in the direction of yarns 1, FIG. 21 shows the fourth embodiment as a view seen at yarn 5 in the direction of yarns 1, FIG. 22 shows a fifth embodiment of the paper machine fabric of the invention as a view seen at yarn 2 in the direction of yarns 1, FIG. 23 shows the fifth embodiment as a view seen at yarn 5 in the direction of yarns 1, FIG. 24 shows a sixth embodiment of the paper machine fabric of the invention as a view seen at yarns 2 and 4 in the direction of yarns 1, FIG. 25 shows the sixth embodiment as a view seen at yarns 5 in the direction of yarns 1, FIG. 26 shows a seventh embodiment of the paper machine fabric of the invention as a view seen at yarns 2 and 4 in the direction of yarns 1, FIG. 27 shows the seventh embodiment as a view seen at yarn 5 in the direction of yarns 1, FIG. 28 shows the seventh embodiment as a view seen at yarns 6 and 4 in the direction of yarns 1, FIG. 29 shows the seventh embodiment as a view seen at yarn 5 in the direction of yarns 1, FIG. 30 shows a detail of a prior-art paper machine fabric, and FIG. 31 shows the corresponding detail of the paper machine fabric of the invention.

FIGS. 1 to 6 show a first embodiment of a paper machine fabric according to the invention. FIG. 1 shows said embodiment as a view seen from the paper side, and FIG. 2, in turn, shows the embodiment of FIG. 1 as view seen from the wear side. FIGS. 3 to 6 show the embodiment of FIGS. 1 and 2 as a view in the direction of the warp yarns and according to the arrows marked in FIGS. 1 and 2.

The embodiment of FIGS. 1 to 6 comprises at least two separate layers formed of at least two separate yarn systems. The above-mentioned yarn systems consist of a yarn system forming the paper side and composed of longitudinal and crosswise yarns and a yarn system forming the wear side and composed of longitudinal and crosswise yarns, the yarn systems being arranged to form structures independent of each other in the longitudinal and cross directions of the fabric. The structures formed in the above-mentioned manner are bound to each other by means of a binding yarn system, whereby the binding yarns in the binding yarn system are arranged to form part of the layer on the paper-side surface.

In the embodiment of FIGS. 1 to 6, the yarn system forming the paper side is made up of a yarn system formed by longitudinal top warps 1 and a yarn system formed by crosswise top wefts 2.

The yarn system forming the wear side is, in turn, made up of a yarn system formed by longitudinal bottom warps 3 and a yarn system formed by crosswise bottom wefts 4.

The terms longitudinal and crosswise refer herein to the longitudinal direction and cross-direction, respectively, of the paper machine fabric. These terms and facts are well known to a person skilled in the art, wherefore they are not explained in greater detail herein.

The paper and wear sides thus formed are bound to each other by means of a binding yarn system. The binding yarns of the binding yarn system are marked with reference number 5. The binding yarns 5 of the binding yarn system form part of the paper-side surface. The binding yarns 5 bind the layers together on the wear side by binding to the wear-side yarns.

In the embodiment of FIGS. 1 to 6, the binding yarns 5 are binding wefts that bind to the bottom warps 3 on the wear side. FIGS. 1 to 6 further show that in the embodiment, the binding yarn system is formed of a binding yarn pair.

According to the essential idea of the invention, each binding yarn 5 of the binding yarn system is arranged on the wear side in the weave pattern repeat to bind to more yarns than on the paper side. In the embodiment of FIGS. 1 to 6, the binding yarns 5 bind to one top warp 1 on the paper side and to two bottom warps 3 on the wear side.

In FIGS. 1 to 6, the top warps 1 and bottom warps 3 are equal in thickness. However, the top warps 1 and bottom warps 3 may also differ in thickness, but they are always of nearly the same thickness.

FIG. 1 shows that in the embodiment, the top wefts 2 and binding weft pairs 5 bind to the top warps 1 as a two-stitch plain weave, that is, on the paper side, each top weft yarn 2 alternately goes over one and under the next warp yarn 1.

FIG. 2 shows the wear side of the paper machine fabric. In FIG. 2, the bottom wefts 4 bind to the bottom warps 3 in an 8-stitch weave, thus forming a long wear-resistant weft float stitch on the wear side. The binding wefts 5 bind to two adjacent bottom warps 3 on the wear side.

In FIGS. 1 and 2, the spaces between the weft and binding yarns have been widened so that the path of the yarns is easier to see. In reality, the binding wefts 5 are on top of each other or nearly so, in which case dewatering openings equal in size are formed on the paper side. This provides even dewatering and no undesired dewatering marking occurs. FIGS. 1 and 2 show that the weft ratio of the structure is 3:2, that is, two bottom wefts 4 correspond to two top wefts 2 and a weft float stitch formed by a binding weft pair 5.

FIGS. 3 to 6 show the paths of all wefts that bind in different manners in the fabric. FIG. 5 shows a top weft 2 that runs over every first top warp yarn 1 and under ever second top warp yarn 1. FIGS. 3 to 6 show that the warp ratio of the fabric is 1:2, that is, two bottom warps 3 correspond to every top warp 1. FIGS. 3 to 6 also show that the top warps 1 and bottom warps 3 are not at the same place but overlap. When the warps are not at the same place, the top warps 1 can settle beside the bottom warps 3 when the fabric is tight in the paper machine, and no internal wear can take place, because no point-form nip pressure is formed between the top and bottom warps. As the warp yarns settle beside each other, the fabric becomes thinner and, thus, makes it a super thin SSB structure.

FIGS. 3 and 4 show individual binding yarns 5 that form a binding weft pair. FIGS. 3 and 4 show that as one binding yarn 5 forms the paper-side surface, the other binding yarn 5 binds two bottom warps 3 on the wear side. FIGS. 3 and 4 also show that the binding yarns 5 run as short a distance as possible between the layers, owing to which the layers bind together as tightly as possible and the fabric becomes stable.

FIGS. 3 and 4 show that the binding wefts 5 only bind one top warp 1 at a time on the top. The paper-side surface then becomes even, since every intersecting point of the yarns is level with the others, and no topography marking occurs in the paper.

| Property | A structure of the invention | Conventional structure bound with a binding yarn pair | Conventional double-layer paper machine fabric | Conventional SSB structure |
|---|---|---|---|---|
| MD YARNS: Ø/density | | | | |
| Top warp (mm/l/cm) | 0.12/29.7 | 0.13/27.9 | 0.15/69.0 | 0.12/34.0 |
| Bottom warp (mm/l/cm) | 0.12/59.8 | 0.13/55.8 | — | 0.18/34.0 |
| CMD YARNS: Ø/density | | | | |
| Top weft (mm/l/cm) | 0.10/28.0 | 0.11/28.2 | 0.16/26.9 | 0.11/21.5 |
| Binding weft (mm/l/cm) | 0.9/14.0 | 0.11/14.1 | — | 0.11/21.5 |
| Bottom weft (mm/l/cm) | 0.19/28.0 | 0.19/28.2 | 0.19/26.9 | 0.25/21.5 |
| T number | 160 | 154 | 123 | 133 |
| S number | 72 | 70 | — | 77 |
| SP number | 1260 | 1180 | 464 | 1462 |
| Permeability ($m^3/m^2h$) | 5500 | 5500 | 5500 | 5500 |
| Wear reserve (mm) | 0.19 | 0.16 | 0.17 | 0.22 |
| Thickness (mm) | 0.55 | 0.66 | 0.59 | 0.71 |
| Interspace coefficient | 0.51 | 0.58 | 0.51 | 0.55 |
| Warp cover factor | 0.358/0.716 | 0.363/0.725 | 1.35/0 | 0.408/0.612 |
| Stitch on paper side/ wear side | 2/8 | 2/6 | 8 | 2/5 |

The attached table is a comparison of the embodiment of the paper machine fabric of the invention according to FIGS. 1 to 6, a conventional double-layer structure and a conventional thin SSB structure. The paper machine fabrics in the table are suitable for running on a paper machine in the same position.

The table shows that the structure of the invention is in the same thickness range as the double-layer structure and clearly thinner than the conventional SSB structure. The interspace coefficient of the structure of the invention is small, so the structure does not transport as much water as the conventional SSB structure. Thus, the structure experiences less rewetting, and when used in the top unit of a paper machine, the structure does not splatter water on the paper web.

FIGS. 7 to 12 show a second embodiment of the paper machine fabric according to the invention. The same reference numbers are used in FIGS. 7 to 12 as in FIGS. 1 to 6 to refer to the corresponding parts.

In the embodiment of FIGS. 7 to 12, the number of top warps 1 and bottom warps 3 is the same, in other words, there are an equal number of longitudinal warps on both the paper and wear sides, that is, the warp ratio of the structure is 1:1.

FIGS. 13 to 17 show a third embodiment of the paper machine fabric according to the invention. The same reference numbers are used in FIGS. 13 to 14 as in FIGS. 1 to 6 and 7 to 12 to refer to the corresponding parts.

Figure 1:
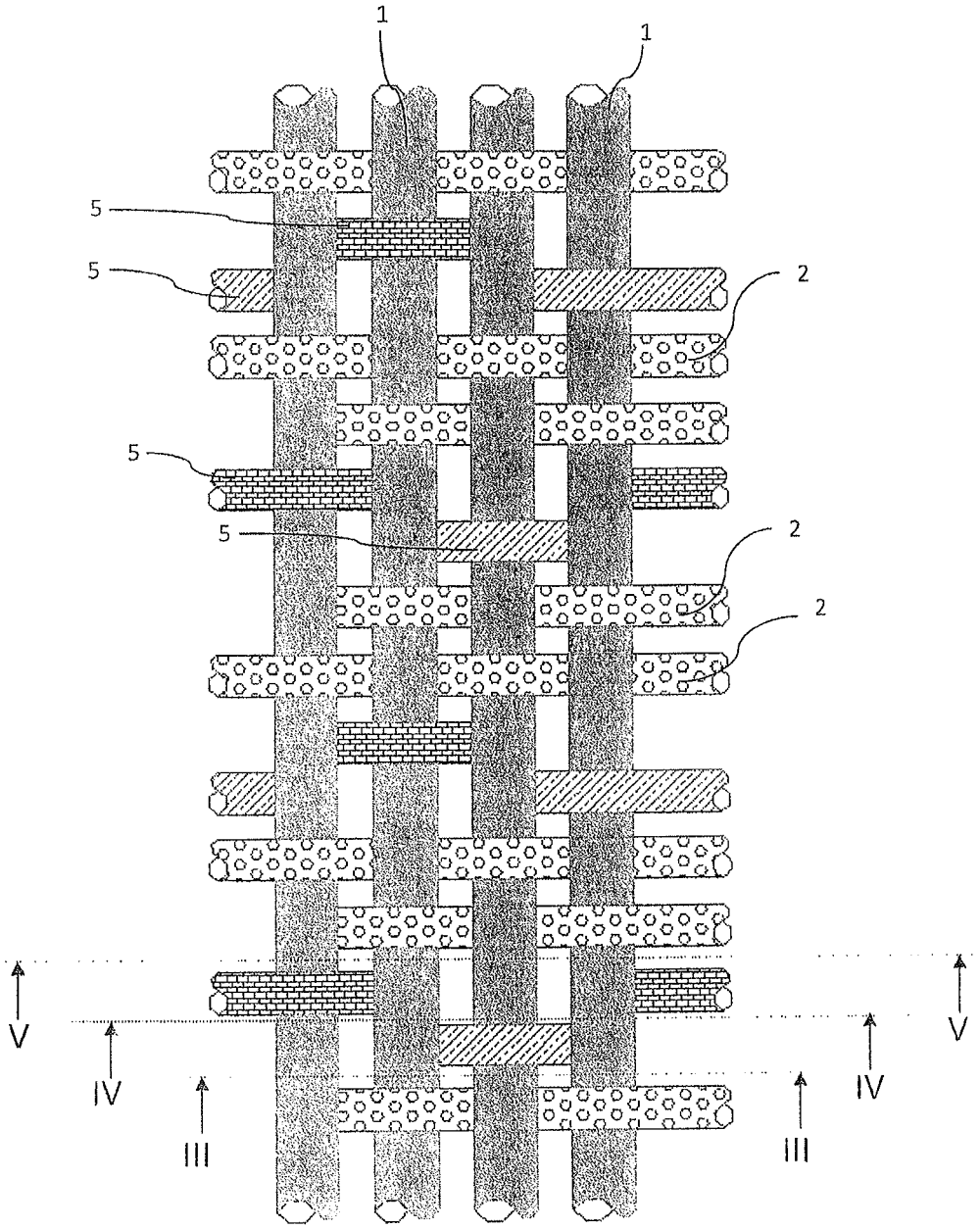
Figure 2:
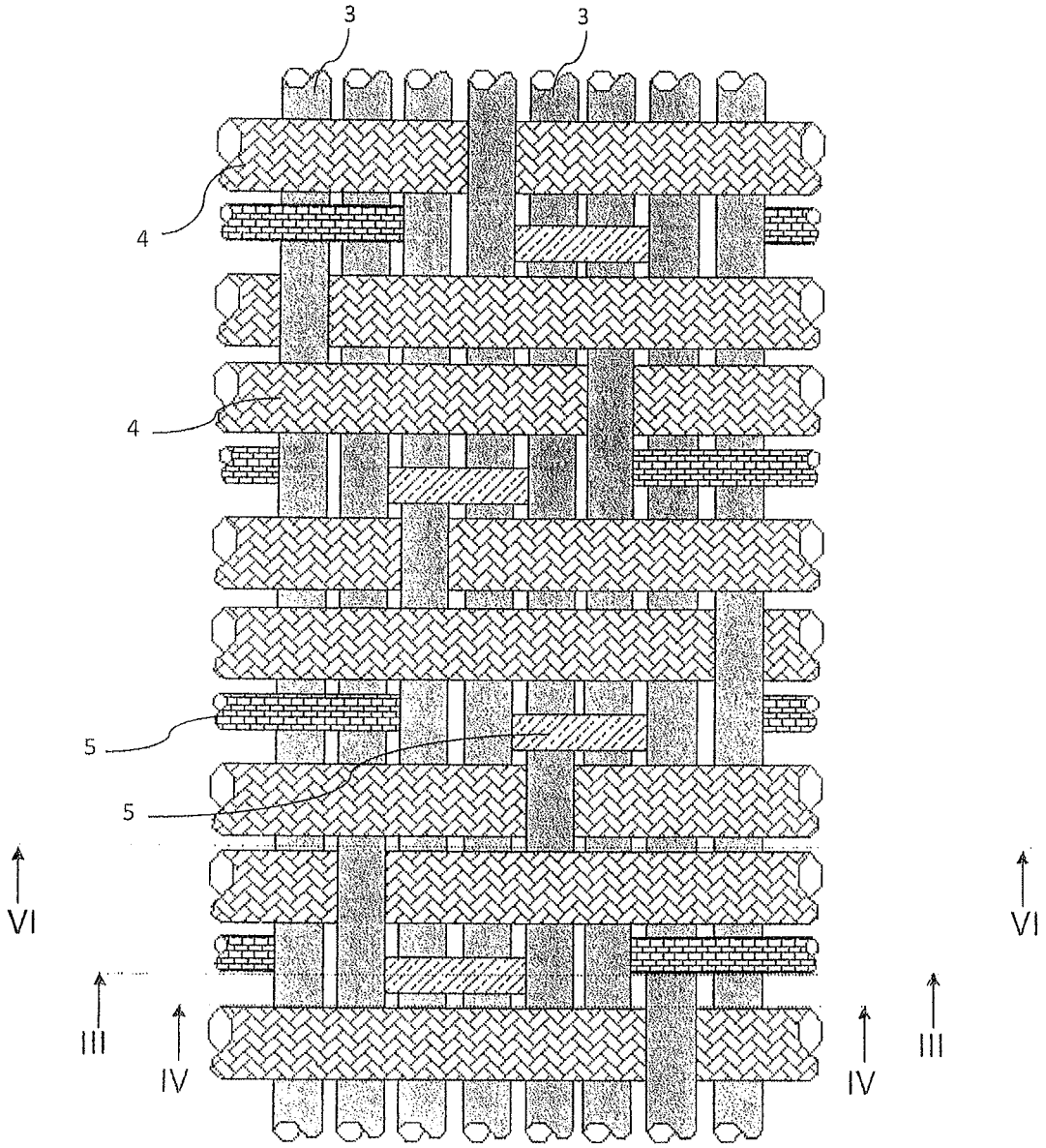
Figure 3:
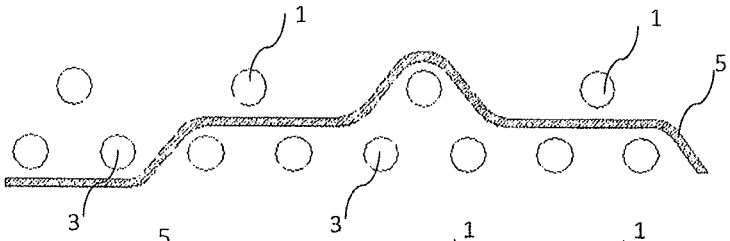
Figure 4:
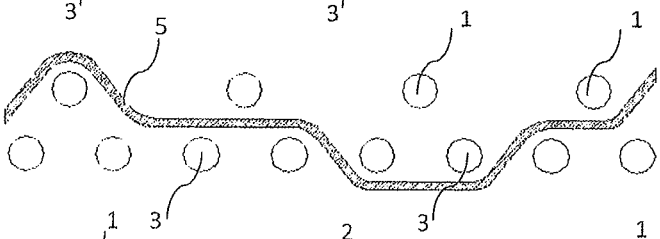
Figure 5:
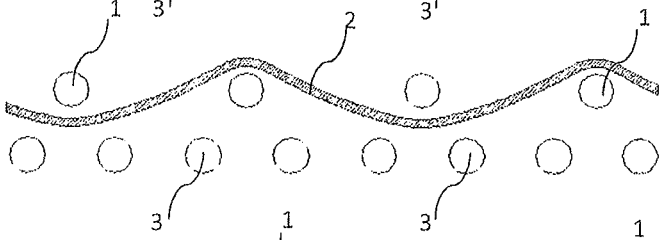
Figure 6:
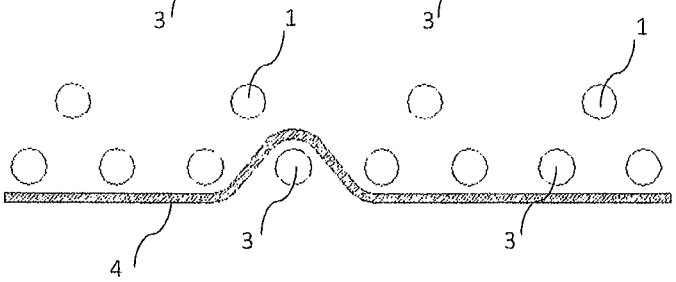
Figure 7:
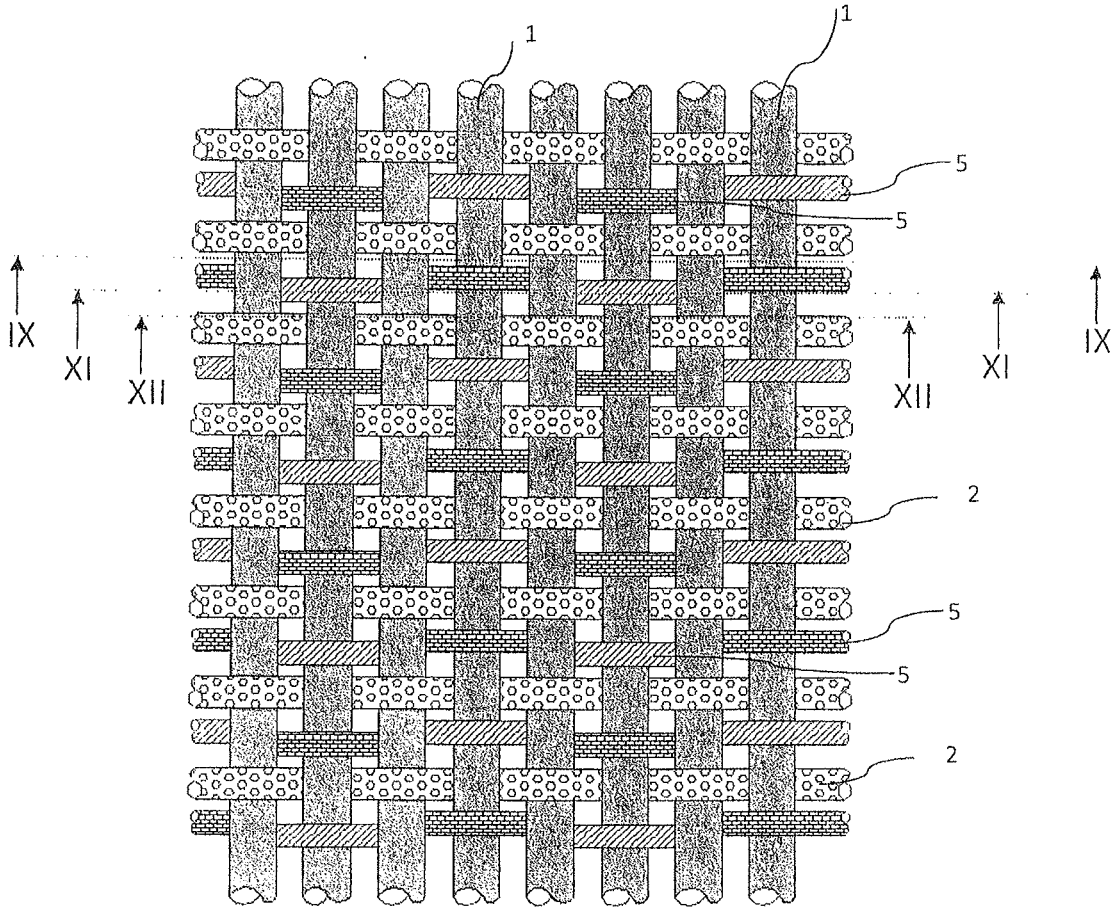
Figure 8:
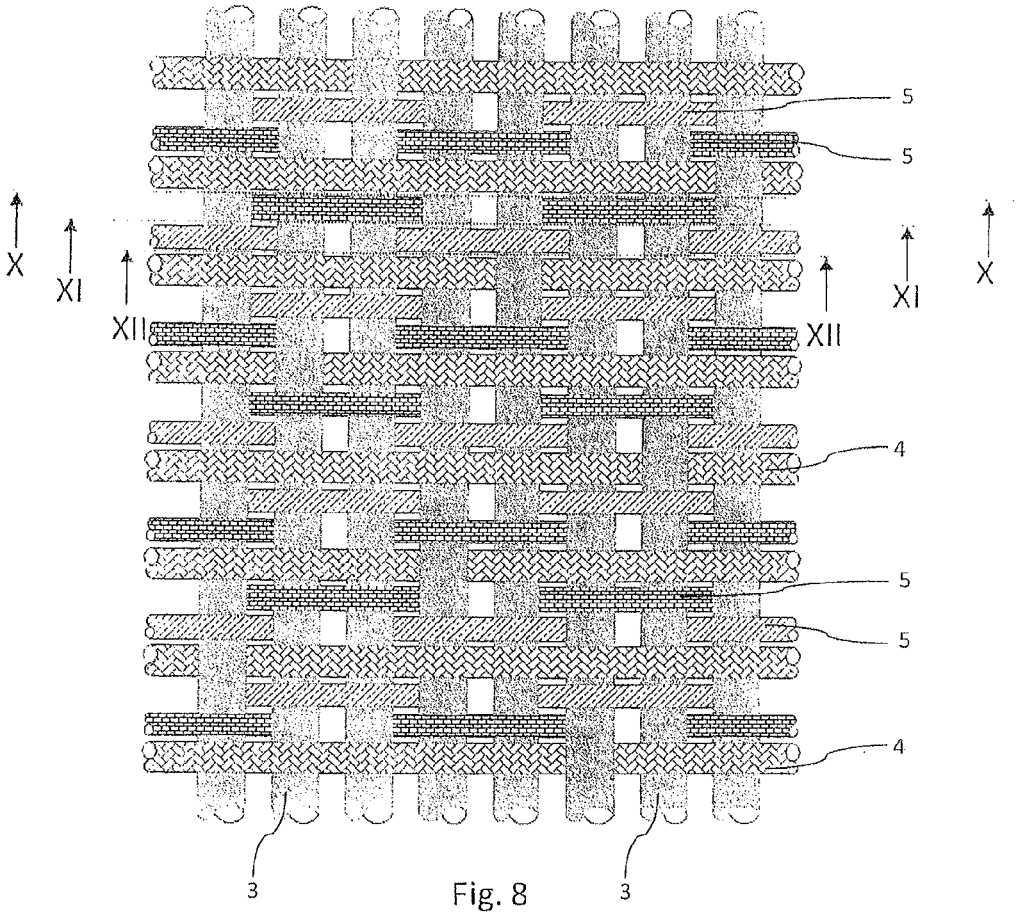
Figure 9:
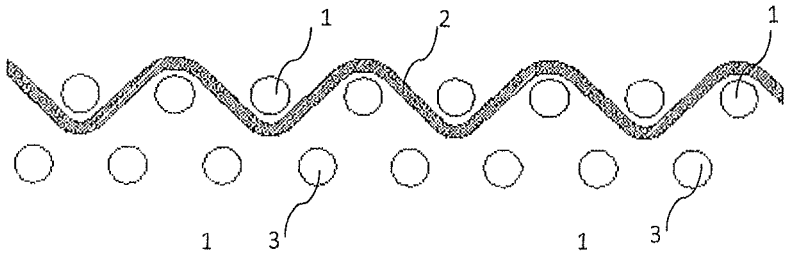
FIGS. 9 to 12 show that this embodiment also provides the advantage that the top warps 1 and bottom warps 3 can settle beside each other as in the embodiment of FIGS. 1 to 6.
Figure 10:
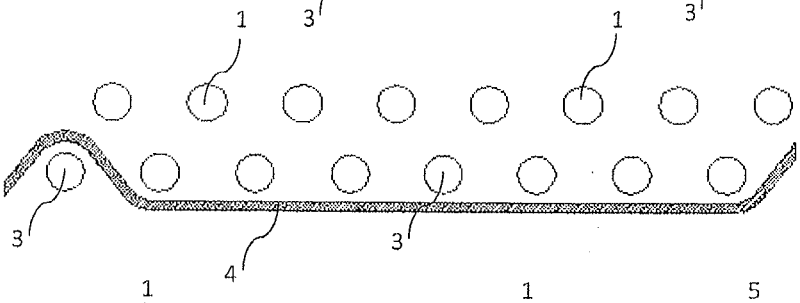
Figure 11:
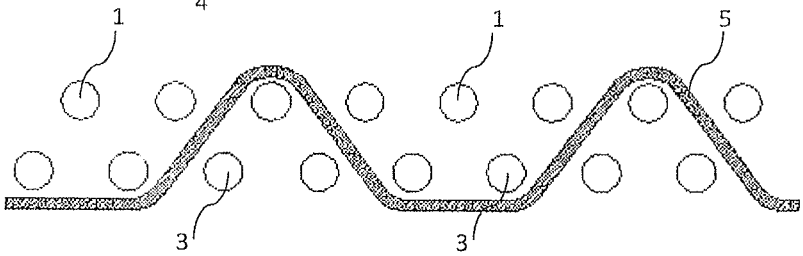
Figure 12:
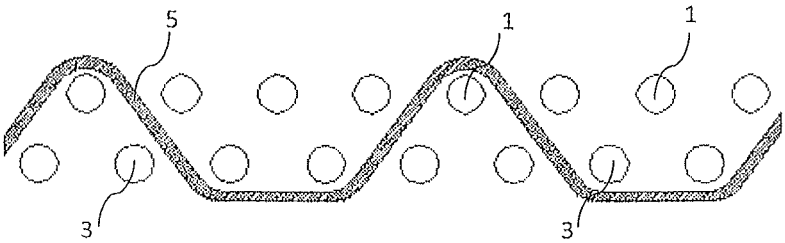
Figure 18:
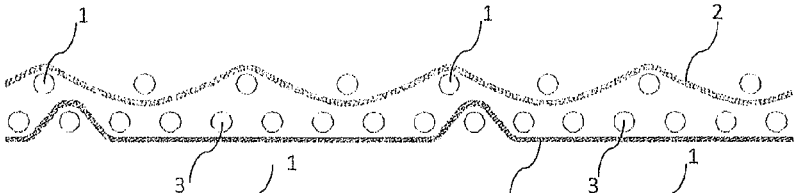
Figure 19:
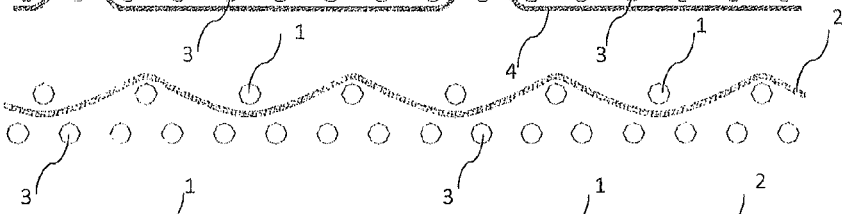
Figure 20:
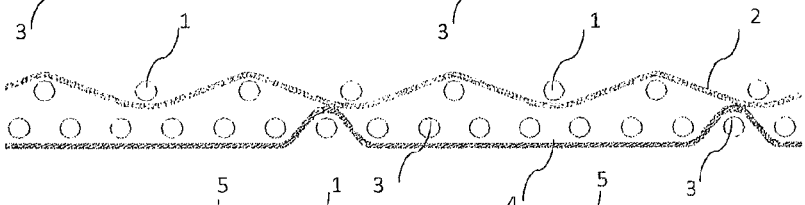
Figure 21:
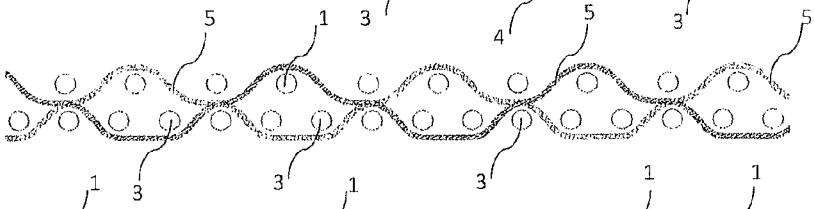

In the embodiment of FIGS. 13 to 17, the warp ratio is 2:3. The top warps 1 and bottom warps 3 are not on top of each other in this embodiment, either, so no point-form pressure forms between them and internal wear remains negligible. The binding yarns 5 bind one top warp 1 on the paper side and two bottom warps 3 on the wear side.

FIGS. 18 to 21 show a fourth embodiment of a paper machine fabric. Here, the embodiment has a warp ratio of 1:2, that is, two bottom warps 3 correspond to one top warp 1, and a weft ratio of 2:1, that is, there are three times less binding yarn pairs formed by binding yarns 5 than top wefts 2 and two times less than bottom wefts 4. The pairs formed by the binding yarns 5 bind to the paper-side top warps in a two-stitch weave and to the bottom warps as a 3½ twill, that is, they bind to two bottom warps 3 and run over one bottom warp 3. In this embodiment, too, the top warp yarns 1 and bottom warp yarns 3 can settle between each other and the binding yarns 5 bind on the wear side to more warps than on the paper side.

Figure 22:
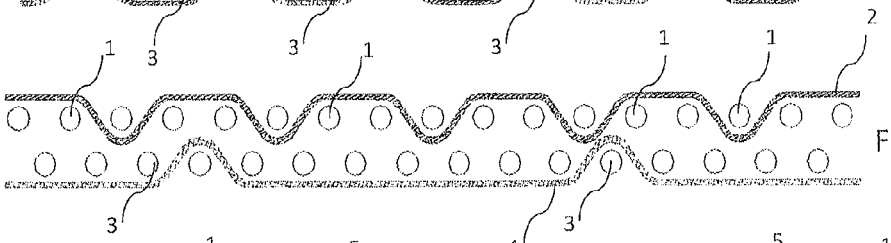
Figure 23:
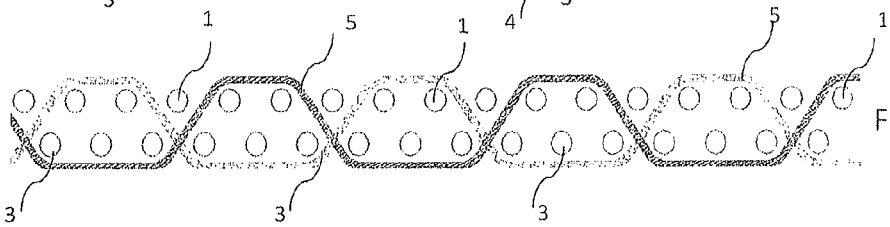

FIGS. 22 to 23 show a fifth embodiment of the paper machine fabric according to the invention. This embodiment has a 3-stitch weave on the paper-side surface. The essential thing in this embodiment, too, is that the binding yarns 5 bind on the wear side in the weave pattern repeat to more yarns than on the paper side.

Figure 24:
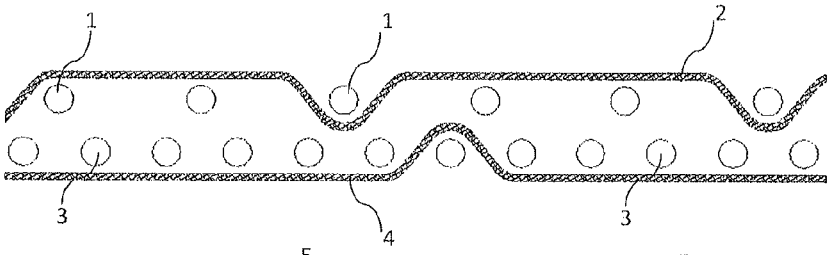
Figure 25:
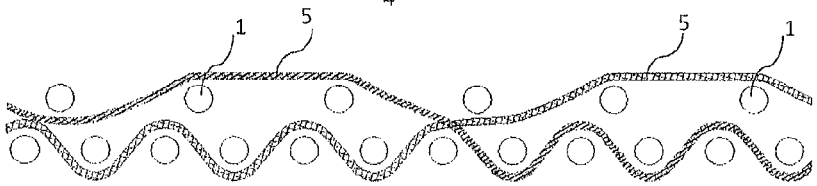
Figure 26:
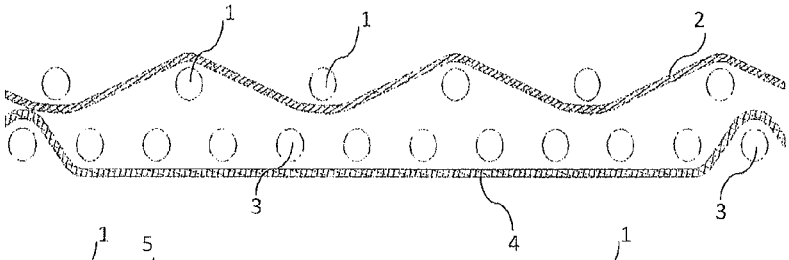
Figure 27:
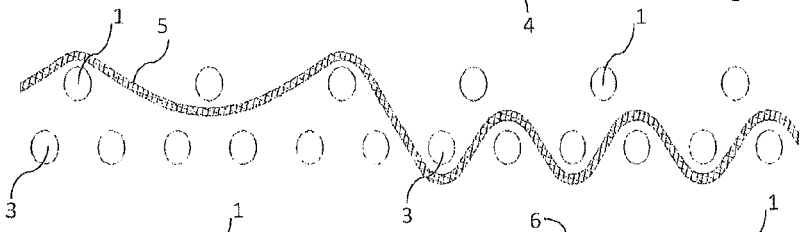
Figure 28:
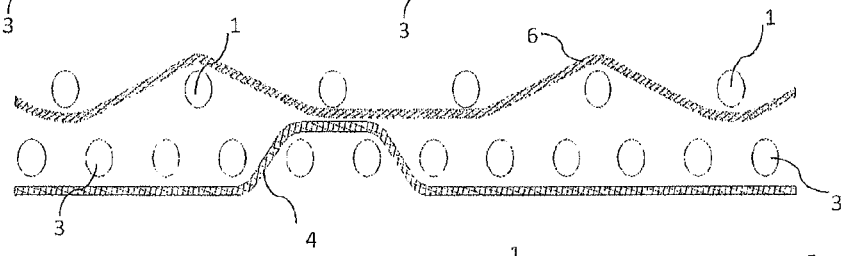
Figure 29:
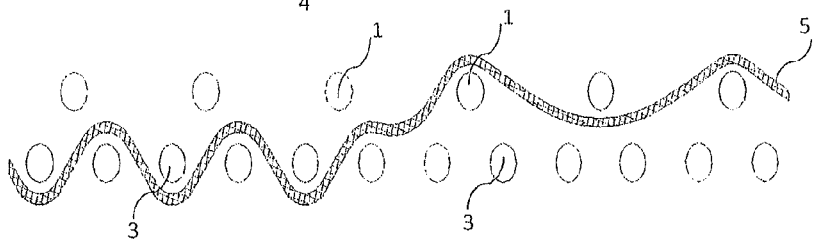

FIGS. 24 to 25 show a sixth embodiment of the paper machine fabric according to the invention. This embodiment has a 3-stitch weave on the paper-side surface. In this embodiment, the pairs formed by the binding yarns 5 form on the paper side a bend by running over two top warp yarns 2 and bind on the wear side to three bottom warp yarns 3, thus forming a 2-stitch float stitch on the wear side. The essential thing in this embodiment, too, is that the binding yarns 5 bind on the wear side in the weave pattern repeat to more yarns than on the paper side. FIG. 24 shows that in this embodiment, the bottom weft yarn 4 binds to the bottom warp yarns 3 in a 12-stitch weave.

FIGS. 26 to 29 show a seventh embodiment of the paper machine fabric according to the invention. In this embodiment, the yarn system forming the paper side contains a substitute yarn 6. A binding yarn 5 is woven on both sides of the substitute yarn 6. The substitute yarn 6 forms together with the binding yarns 5 two unbroken float stitches on the paper side and supplements the float stitches of the binding yarns 5 at locations where the above-mentioned binding yarns 5 bind on the paper side. This embodiment has a 2-stitch paper side. The binding yarns 5 form on the paper side two bends and on the wear side three bends. The essential thing in this embodiment, too, is that the binding yarns 5 bind on the wear side in the weave pattern repeat to more yarns than on the paper side.

Figure 30:
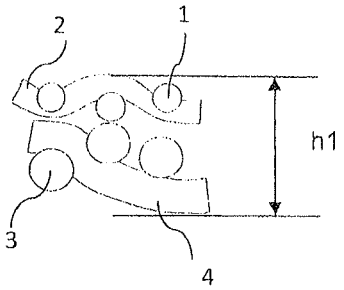
Figure 31:
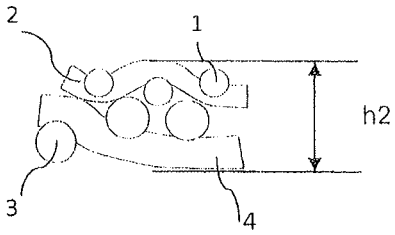

FIGS. 30 to 31 show the run of the weft yarn in a conventional SSB structure and in an embodiment of the paper machine fabric of the invention. The same reference numbers are used in FIGS. 30 to 31 as in the other figures to refer to the corresponding parts.

FIG. 30 shows that the conventional SSB wire is at least four yarns thick, since the top warp 1 and bottom warp 3 cannot settle beside each other as in the paper machine fabric of the invention that is shown in FIG. 31, and the bottom weft 4 settles between warps 1 and 3 and the top weft 2 settles on top of the top warp 1. Even if the structure shown in FIG. 31 used yarns of similar thickness as those used in the structure shown in FIG. 30, the structure shown in FIG. 31 would remain thinner, only three-yarns thick, because the top warp 1 and bottom warp 3 can settle beside each other owing to the distributed warp system. In the structure shown in FIG. 31, the bottom weft 4 runs straighter, which also makes the structure thinner. The wire thicknesses are shown in FIGS. 30 and 31 with reference markings h1 and h2.

The above examples are not intended to limit the invention in any way, but the invention may be varied freely within the scope of the claims. Therefore, it is clear that the paper machine fabric of the invention or its details need not be exactly as shown in the figures, and solutions of other type are also possible. The structure of the invention described above has three layers, but other multilayer structures are also possible within the scope of the invention. In the examples, the paper-side surface is shown as a two- or three-stitch weave and the path of the bottom weft as an 8-stitch or 12-stitch satin, but other weaves are also possible. With products less prone to wear, such as Tissue, it is possible to use as the bottom weft less than 8-stitch solutions, 6-stitch weaves, for instance, but an at least 8-stitch wear side is most advantageous in structure. The essential thing is that the binding yarn binds to more warps on the wear side than on the paper side. The warp and weft ratios may vary. The top/bottom warp ratio may be 1:1, 2:3, 1:2, as in the above solutions, but the warp ratio may also be 3:2, 4:3, etc. The top/bottom weft ratio may be 1:1 or 2:1, as in the above solutions, but the weft ratio may also be 3:2, 4:3, 5:2, 3:1, 7:5, etc. All of the structures shown in the examples have top wefts, but it is also possible to use a structure with no top weft. In addition, it is possible to use a substitute weft in the structure.

In the above examples, the invention is described by presenting embodiments in which the binding yarns are binding wefts. However, the invention may also be adapted so that the binding yarns are binding warps.

The invention is used in a wet wire, but it may also be used in other positions of a paper machine as a press felt or drying wire, for example.

Polyester and polyamide yarns with a round diameter have been used in the solutions described above. Other possible yarn materials are PBT (polybutene terephthalate), PEN (polyethylene naphthalate) or PPS (polyphenyl sulphide) or a mixture thereof. The yarns may be made of a material that contains carbon nanotubes, for instance. The yarns may be profile yarns, the cross-section of which differs from round and is flat, oval, rectangle, or some other shape, for instance. The yarns may also be hollow, in which case they can flatten in the fabric, and the structure can be made even thinner than before. It is possible to affect the properties of the fabric by the choice of yarn properties, for example the structure can be made thinner or stronger than before for special installations, or the paper-side surface more even.

The invention claimed is:

1. Paper machine fabric that comprises at least two separate layers that are formed of at least two separate yarn systems, one forming a paper side and composed of longitudinal and crosswise yarns and one forming a wear side and composed of longitudinal and crosswise yarns, the at least two separate yarn systems being arranged to form structures independent of each other in longitudinal and cross directions of the fabric, and the structures being bound to each other by a binding yarn system, wherein binding yarns of the binding yarn system comprise binding wefts and each binding yarn of the binding yarn system is arranged to form part of a layer on a surface of the paper side, wherein each binding yarn of the binding yarn system is arranged to bind in a weave pattern repeat on the wear side to more yarns than on the paper side and that the binding yarns are arranged to form on the paper side with each other or together with a substitute yarn a same binding as the paper-side yarns in a corresponding direction, wherein longitudinal warp yarns of the fabric are arranged to settle beside each other.

2. A paper machine fabric as claimed in claim 1, wherein the binding yarn system comprises binding yarn pairs.

3. A paper machine fabric as claimed in claim 2, wherein the binding yarns in a binding yarn pair are arranged to form an equal number of bends on the paper side.

4. A paper machine fabric as claimed in claim 1, wherein a top and bottom warp ratio of the longitudinal warp yarns in the fabric is <1.

5. A paper machine fabric as claimed in claim 1, wherein a warp ratio is 1:1, 2:3, 1:2, 3:2, 4:3, etc.

6. A paper machine fabric as claimed in claim 5, wherein a top/bottom weft ratio is 1:1, 2:2, 3:2.4:3, 5:2, 3:1, 7:5, etc.

7. A paper machine fabric as claimed in claim 2, wherein the binding yarns in the binding yarn pairs are arranged to bind in different manners to each other.

8. A paper machine fabric as claimed in claim 1, wherein the yarns of the fabric are at least partly round in cross-section, at least partly profile yarns, or/and at least partly hollow yarns.

9. A paper machine fabric as claimed in claim 1, wherein the longitudinal warp yarns of the fabric are essentially equal in thickness.

10. A paper machine fabric as claimed in claim 1, wherein a thickness of the binding yarns is 0.08 to 0.10 mm.

11. A paper machine fabric as claimed in claim 1, wherein the yarn system forming the paper side comprises a substitute yarn with a binding yarn woven on both sides thereof, and the substitute yarn is arranged to complement on the paper side two float stitches formed by the binding yarns woven on both of its sides at locations where the binding yarns woven on both sides of the substitute yarn bind on the wear side.

12. A paper machine fabric as claimed in claim 1, wherein top wefts and binding yarn pairs bind to top warps as a two-stitch plain weave, that bottom wefts bind to bottom warps in an 8-stitch weave and the binding wefts bind on the wear side to two adjacent bottom warps.

13. A paper machine fabric as claimed in claim 12, wherein a warp ratio of the fabric is 1:2 and that the top warps and bottom warps settle beside each other.

14. A paper machine fabric as claimed in claim 1, wherein the yarns of the fabric are polyester yarns, polyamide yarns, PBT yarns, PEN yarns, PPS yarns, or yarns made of a mixture thereof.

15. A paper machine fabric as claimed in claim 1, wherein yarns are made of a material that contains carbon nanotubes.

16. A paper machine fabric as claimed in claim 1, wherein the wear side is an at least 6-stitch fabric.

* * * * *